United States Patent [19]

Ikeda et al.

[11] Patent Number: 4,763,563

[45] Date of Patent: Aug. 16, 1988

[54] SWASH PLATE UTILIZED FOR SWASH PLATE TYPE COMPRESSOR

[75] Inventors: Hayato Ikeda; Masayuki Kurahashi; Fukuo Gomi, all of Kariya, Japan

[73] Assignee: Kabushiki Kaisha Toyoda Jidoshokki Seisakusho, Aichi, Japan

[21] Appl. No.: 122,257

[22] Filed: Nov. 18, 1987

[30] Foreign Application Priority Data

Nov. 26, 1986 [JP] Japan ..... 61-182684[U]

[51] Int. Cl.[4] ..... F01B 3/00; F04B 1/12; F04B 27/03; F16H 23/00

[52] U.S. Cl. ..... 92/71; 92/147; 92/57; 417/269; 417/DIG. 1; 74/60; 74/567

[58] Field of Search ..... 92/12.2, 57, 71, 147; 91/502, 506; 417/269, DIG. 1; 74/60, 567

[56] References Cited

U.S. PATENT DOCUMENTS

| | | | |
|---|---|---|---|
| 3,246,575 | 4/1966 | Raymond | 91/507 |
| 4,432,310 | 2/1984 | Waller | 91/502 |
| 4,473,309 | 9/1984 | Box | 384/905 |

FOREIGN PATENT DOCUMENTS

| | | | |
|---|---|---|---|
| 2418894 | 4/1973 | Fed. Rep. of Germany | 91/502 |
| 0024304 | 2/1979 | Japan | 417/269 |
| 0028881 | 2/1982 | Japan | 417/DIG. 1 |
| 0135677 | 12/1983 | Japan | 417/269 |
| 576086 | 5/1976 | Switzerland | 74/60 |

*Primary Examiner*—Robert E. Garrett
*Assistant Examiner*—Thomas E. Denion
*Attorney, Agent, or Firm*—Burgess, Ryan & Wayne

[57] ABSTRACT

A swash plate (3) incorporated in a swash plate type compressor and comprising a boss (10) typically formed of aluminum material, which is fixedly secured on a drive shaft (2), and a swash plate assembly (11) extending obliquely from the boss (10), which assembly comprises a pair of front and rear contact plates (12) made of iron and brought into contact with a pair of shoes (6) which are accommodated in recesses (15*a*) of a piston (5), a connecting member (13) made of iron rigidly connecting the pair of contact plates (12), and a filler (14) made of aluminum material which completely fills the internal spaced formed between the contact plates (12). According to this structure, the change of the distance between recesses (15*a*) for accommodating the shoes (6) due to the expansion or shrinkage of the piston (5) is compensated by the change of the thickness of the plate assembly (11), whereby the shoe clearance is always kept constant even during a high speed operation of the compressor or in an operation in a low temperature atmosphere, while the slidability of the shoe (6) against the contact plate (12) is maintained at the same level.

4 Claims, 4 Drawing Sheets

SWASH PLATE UTILIZED FOR SWASH PLATE TYPE COMPRESSOR

BACKGROUND OF THE INVENTION

1. Technical Field of the Invention

The present invention relates to a swash plate type compressor for use in air conditioning system for vehicles and, in particular, to an improved structure of the swash plate therefor.

2. Description of the Related Art

A typical swash type compressor is disclosed, for example, in U.S. Pat. No. 4,431,378 to M. HATTORI et al, issued on Feb. 14, 1984, in which, as illustrated in FIG. 5, a pair of horizontal axially aligned cylinder blocks 1 forming a combined cylinder block are rotatably supported by a drive shaft 2 which also fixedly carries an iron swash plate 3. Inside the combined cylinder block are formed axially extending cylinder bores 4 arranged equi-angularly in the cross-section of the cylinder block. The cylinder block is closed at both ends by front and back housings 17, 19 via valve plates 16, 18. A double acting piston 5 made of aluminum is slidably fitted in the respective cylinder bore, and between the respective piston 5 and the swash plate 3, is arranged an iron shoe 6 in a semi-spherical shape with a predetermined shoe clearance both between the piston 5 and the shoe 6, and between the shoe 6 and the swash plate 3.

In the case of the above conventional iron swash plate, the slidability between the shoe 6 (made of iron) and the swash plate 3 is good because of the homogeneity of the material used. This iron swash plate, however, has an inherent drawback of a heavier weight. In addition, in the lower temperature atmosphere, the piston 5 (made of aluminum) contracts more than the iron swash plate 3 and the shoe clearance becomes smaller, resulting in a seizure therebetween. Conversely, the shoe clearance becomes larger when the compressor is operated at a high speed, and this causes abnormal noise.

Recently, it has been suggested to adopt an improved swash plate formed by aluminum material having a lower density so as to reduce a total weight of the compressor or minimize a moment of inertia of the moving mass, as disclosed in Japanese Unexamined Utility Model Publication (Kokai) No. 54-55711.

Some problems, however, have arisen in this attempt due to a far higher coefficient of thermal expansion of aluminum material relative to iron when the compressor fitted with the aluminum swash plate is operated in the low temperature atmosphere or when the respective parts thereof become hot during the high speed operation. That is, in the case of the aluminum swash plate, although the problems inherent to the iron swash plate are eliminated, other drawbacks arise of a reduced rigidity due to the softening property of the aluminum material in the high temperature and a lower slidability between the shoe and the swash plate during a high speed operation.

SUMMARY OF THE INVENTION

Thus, an object of the present invention is to provide a novel structure of a swash plate for use in a swash plate type compressor, which is improved over the conventional structure of the swash plate in that it is resistant to seizure and noise during a high speed operation of the compressor.

According to the present invention, there is provided, in a swash plate type compressor comprising a drive shaft axially and rotatably secured in the center of a cylinder block, a swash plate inserted and fixed onto the drive shaft, a plurality of pistons made of aluminum material, each being slidably inserted in the respective bores provided in the cylinder block, a plurality of pairs of shoes made of iron, each pair of shoes being arranged in recesses provided in the respective piston so as to nip the swash plate on the front and rear surfaces thereof with a predetermined shoe clearance, wherein the swash plate comprises a boss formed of a light weight material such as aluminum material or a synthetic resin and fixedly secured on the drive shaft, and a swash plate assembly extending obliquely from the boss, which assembly comprises a pair of front and rear contact plates made of iron and on contact with the respective shoe of the pair of shoes, a connecting member made of iron ridigly connecting the pair of contact plates, and a filler made of the light weight material which completely fills the internal space formed between the contact plates.

According to the above structure, since the swash plate is formed of a light weight material except for the contact plate and the connecting member, the total weight of the swash plate is considerably decreased, while the contact plate made of iron ensures a good slidability between the same and the iron shoe. Moreover, since the filler of a light weight material filling the space between the contact plates has a higher coefficient of thermal expansion than that of iron, the contact plates are displaced, when the temperature of the swash plate is elevated, by the expansion of the filler to further increase the distance between both plates than when the distance is naturally increased by the expansion of the connecting member. As a result, the outer surface of the front and rear contact plates are displaced away from each other in opposite directions by an even amount relative to the center plane of the connecting member. Conversely, when the swash plate is operating in a low temperature, both the contact plates are brought closer together by a reverse action to the above. Thus, even in a high speed operation or in an operation in the low temperature atmosphere, the total thickness of the swash plate changes in accordance with the thermal expansion of the aluminum piston, whereby the shoe arranged between the recess in the piston and the contact plate always substantially maintains a constant shoe clearance.

Further, provision of the iron connecting member improves the rigidity of the swash plate per se, compared to the case when the same is formed only of aluminum material.

In an advantageous aspect of the present invention, the connecting member may be circularly arranged in the middle of the contact plate. According to this structure, the displacement of the contact plate by the thermal effect becomes uniform both in the base portion and in the periphery portion.

BRIEF DESCRIPTION OF THE DRAWINGS

The present invention will become made clearer by the following description of the preferred embodiment with reference to the accompanying drawings, wherein.

DESCRIPTION OF THE PREFERRED EMBODIMENTS

Figure 1:
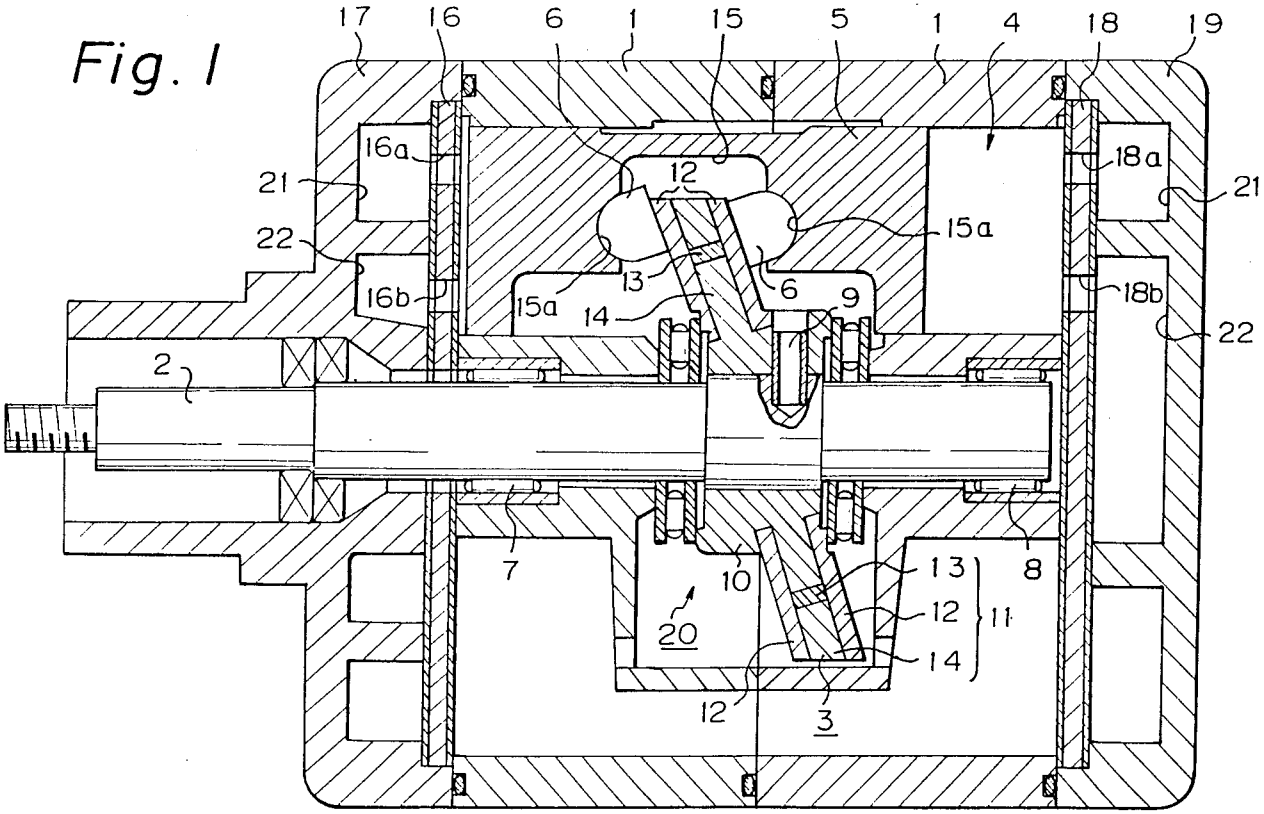
FIG. 1 is a side sectional view of a swash plate type compressor incorporating a swash plate according to the present invention.
Figure 2:
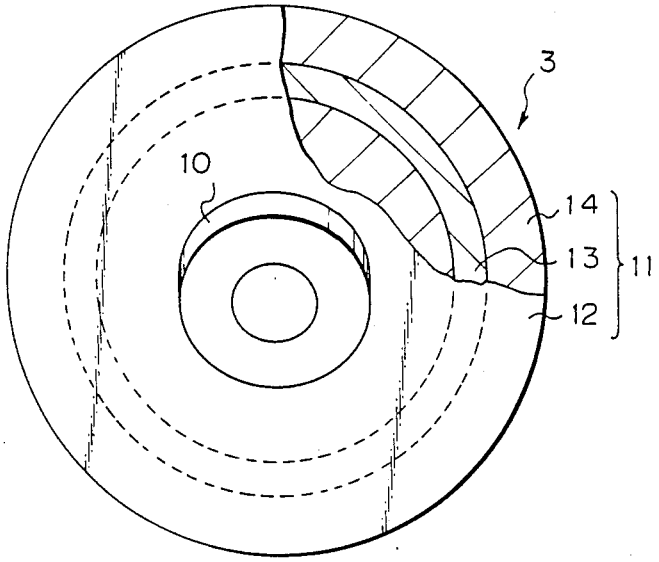
FIG. 2 is a partially broken front view of an embodiment of a swash plate according to the present invention.

With reference to FIGS. 1 and 2, illustrating one embodiment of the present invention, the compressor has a pair of cylinder blocks 1, through the center of which is inserted a drive shaft 2 rotatably supported by bearings 7 and 8. A swash plate 3 is fixedly secured on the drive shaft 2 by a spring pin 9. The swash plate 3 is constituted by a boss 10 made of a light weight material, such as aluminum, and a disc-like plate assembly 11 extending obliquely from the periphery of boss 10.

The plate assembly 11 includes a pair of front and rear contact plates 12 made of iron and brought into contact with shoes 6 described later, an annular connecting member made of iron and fixedly connecting the pair of contact plates 11, and a filler 14 made of an aluminum material the same as the material used for the boss 10 and filling the internal space between the pair of contact plates 11 except for the connecting member 13. According to this structure, when heat is applied to the plate assembly 11, the aluminum filler 14 is expanded to a greater extent than the iron connecting member 13, due to the difference between their coefficients of thermal expansion, whereby the distance between both contact plates 12 is increased, against the resistance of the connecting member 13, which, in turn, increases the thickness of the plate assembly 11 itself. It is apparent from the same mechanism that the thickness of the plate assembly will is decreased when the temperature thereof is lowered.

The swash plate 3 is preferably manufactured by preparing one of the contact plates 12 by casting iron. The other plate 12 is also prepared by casting iron integrally with the annular connecting member 13. In this regard, it should be noted that the connecting member 13 has a plurality of notches (not shown) for communication between the central and peripheral regions, the reason for which will be described later. The two contact plates 12 are fixedly assembled to form a predetermined structure in the conventional manner, for example, by a screw means. Then, the assembled plates are introduced into a mold and aluminum material for the boss 10 and the filler 14 is integrally cast to form the plate assembly 11. During the casting, the aluminum material is distributed throughout the internal space between the contact plates 12 through the notches provided in the connecting member and fills that space.

In this text, "aluminum material" stands for not only pure aluminum but also the alloy thereof.

Through the cylinder block 1, a plurality of bores 4 are arranged so as to be equi-angularly distributed in the cross-section thereof. A piston 5 made of aluminum material is slidably fitted in the respective bore 4. The piston 5 has a central cavity 15 to receive the plate assembly 11. The opposite inner walls of the piston 5 confronting the cavity 15, respectively, having a semi-spherical recess 15*a*, in which a corresponding semi-spherical shoe 6 made of iron is accommodated with a predetermined shoe clearance therebetween. The shoe 6 is slidably brought into contact with the piston 5 by a spherical surface and with the contact plate 12 by a flat surface. Thus, when the swash plate 3 is made to rotate in a plate chamber 20 communicated with a suction flange (not shown), the piston 5 is forcibly reciprocated in the bore 4 via the pair of shoes 6.

At the front end surface of the cylinder block 1 is fitted a front housing 17 via a front valve plate 16 provided with a suction aperture 16*a* and a exhaust aperture 16*b*. Similarly, a rear housing 19 is fitted at the rear end surface of the cylinder block 1 via a rear valve plate 18 provided with a suction aperture 18*a* and an exhaust aperture 18*b*. A suction chamber 21 is formed in the peripheral region of the front and rear housings 17 and 19, communicated to the plate chamber 20. While, an exhaust chamber 22 is formed in the central region of the housings, communicated to an exhaust flange (not shown). These apertures 16*a*, 18*a*, 16*b* and 18*b*, respectively, have a reed valve (not shown).

Now the operation of the swash plate type compressor incorporating the swash plate of the above structure will be described below:

As the drive shaft 2 is connected to a power source via an electro-magnetic clutch (not shown), the former is made to rotate to turn the swash plate 3 fixed thereto, whereby the piston 5 is reciprocated in the bore 4 to compress the operating fluid.

When the compressor is operated at a high speed, the temperature of the respective parts of the compressor elevates and the piston 5 expands to elongate the distance between the front and rear recesses 15*a*. While, as the filler 14 is formed of the same material as the piston, i.e., aluminum material, which has a larger coefficient of thermal expansion than that of iron, this portion also largely expands to press the contact plates 12 away from each other. Since both the contact plates 12 are rigidly connected by the connecting member 13, both the contact plates 12 are made to evenly displace in the front and rearward directions, respectively, relative to the central plane of the connecting member 13 so that the compressive force applied to the filler 14 is balanced with the stretching force applied to the connecting member. This means that the thickness of the plate assembly 11 itself is increased at a rate substantially equal to a coefficient of thermal expansion of the aluminum material forming the piston 5 and the shoe clearance is always kept substantially constant.

When the compressor is operated in the low temperature atmosphere, the piston 5 shrinks to shorten the distance between the front and rear recesses 15*a*, while the thickness of the plate assembly 11 decreases to keep the shoe clearance substantially constant.

According to the above effects, the seizure between the shoe 6 and both the contact plate 12 and the piston 5 as well as an abnormal noise during the operation can be completely prevented. Moreover, the followability of the swash plate 3 in the high speed operation can be improved by the reduction of a moment of inertia due to the light weight swash plate.

The slidability of the plate assembly 11 against the shoe 6 can be further improved relative to the conventional aluminum swash plate because the contact plate 12 is made of iron, as is the shoe 6. This effect is significant during the high speed operation. Provision of the iron connecting member 13 further enhances the rigidity of the swash plate 3 than when it is constituted only by aluminum material, whereby the swash plate can be prevented from deformation even when a heavy load is applied thereon.

Since the connecting member 13 is arranged in the middle area of the contact plate 12, a uniform displacement of the contact plate 12 in the peripheral and central areas by the thermal expansion or shrinkage of the plate assembly 12 can be ensured.

In another advantage, since the swash plate 3 is constituted by a plurality of parts, each being made of aluminum material and iron, respectively, the natural frequencies of the respective parts do not coincide, whereby a resonance of the compressor can be avoided.

Figure 3:
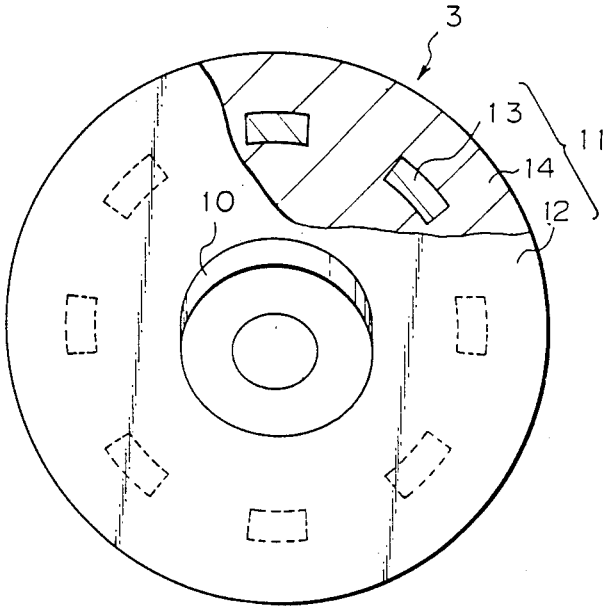
FIG. 3 is a view similar to FIG. 2 and illustrating another type of swash plate according to the present invention.
Figure 4:
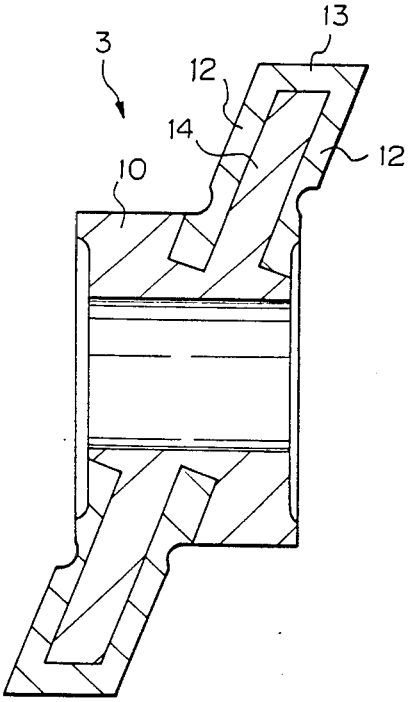
FIG. 4 is a side sectional view of a further type of swash plate according to the present invention.
Figure 5:
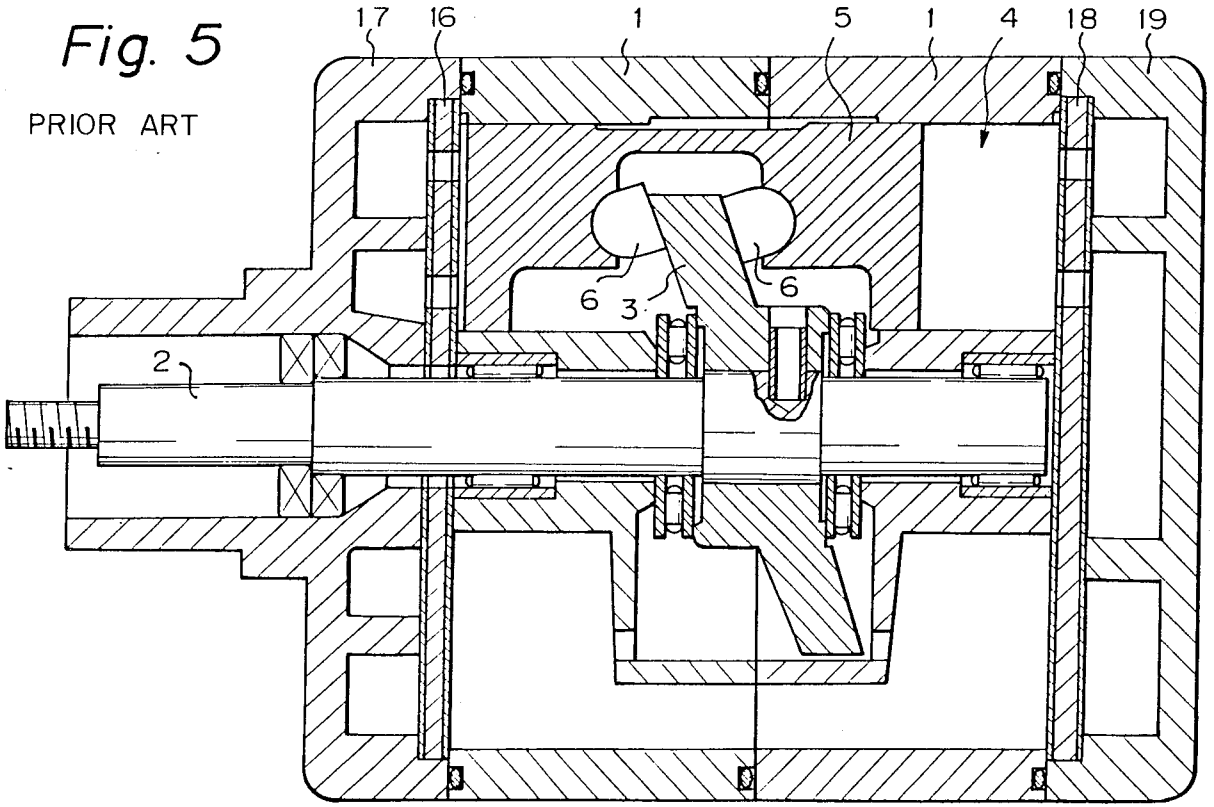
Fig. 5 PRIOR ART
FIG. 5 is a side sectional view of the conventional swash plate type compressor.

It should be understood that the present invention is not limited to the embodiment described above, but may be modified as follows without departing from the spirit of the present invention:

(1) The connecting member 13 may be in a discrete form illustrated in FIG. 3. In addition, the respective portions of the connecting member in FIG. 3 may not be arranged on one circle as illustrated but in a staggered form. Further, as illustrated in FIG. 4, the connecting member 13 may be arranged on the extreme edge of the contact plates 12.

(2) Aluminum material may be replaced by other light weight material, such as synthetic resin or a composite thereof reinforced by a carbon fiber or the like. In this regard, generally the synthetic resin has a considerably higher coefficient of thermal expansion than that of the aluminum material. Since the force caused by the expansion, however, is not so large in the case of the synthetic resin as in the case of the aluminum material, the thickness of the swash plate 3 can be also well adjusted by this replacement.

We claim:

1. In a swash plate type compressor comprising a drive shaft axially and rotatably secured in the center of a cylinder block, a swash plate inserted and fixed onto the drive shaft, a plurality of pistons made of aluminum material, each being slidably inserted in the respective bore provided through the cylinder block, a plurality of pairs of shoes made of iron, each pair of shoes being arranged in recesses provided in the respective piston so as to nip the swash plate on the front and rear surfaces thereof with a predetermined shoe clearance, wherein the swash plate comprises a boss formed of a light weight material such as aluminum material or synthetic resin and fixedly secured on the drive shaft, and a swash plate assembly extending obliquely from the boss, which assembly comprises a pair of front and rear contact plates made of iron and in contact with the respective shoe of the pair of shoes, a connecting member made of iron rigidly connecting the pair of contact plates, and a filler made of the light weight material which completely fills the internal space formed between the contact plates.

2. A swash plate defined by claim 1, wherein the connecting member is circularly arranged in the middle area of the contact plate.

3. A swash plate defined by claim 2, wherein the connecting member is in the form of an annular ring.

4. A swash plate defined by claim 2, wherein the connecting member is formed by a plurality of discrete parts uniformly distributed on the contact plate.

* * * * *